US008549754B2

(12) United States Patent
Bung et al.

(10) Patent No.: US 8,549,754 B2
(45) Date of Patent: Oct. 8, 2013

(54) ROTATING HEAD MULTI-ANGLED CUTTING KNIFE

(76) Inventors: Hubert J. Bung, Wichita, KS (US); Elwood Dean Quimby, Derby, KS (US)

( * ) Notice: Subject to any disclaimer, the term of this patent is extended or adjusted under 35 U.S.C. 154(b) by 0 days.

(21) Appl. No.: 13/385,981

(22) Filed: Mar. 19, 2012

(65) Prior Publication Data

US 2012/0240413 A1 Sep. 27, 2012

Related U.S. Application Data

(60) Provisional application No. 61/465,471, filed on Mar. 21, 2011.

(51) Int. Cl.
*B26B 1/04* (2006.01)
*B26B 5/00* (2006.01)

(52) U.S. Cl.
USPC ..... 30/161; 30/155; 30/287; 30/340

(58) Field of Classification Search
USPC ..... 30/321, 151, 155–161, 164, 286, 30/287, 340, 342
See application file for complete search history.

(56) References Cited

U.S. PATENT DOCUMENTS

| | | | | |
|---|---|---|---|---|
| 670,120 | A * | 3/1901 | Van Tuyl | 30/144 |
| 3,518,758 | A | 7/1970 | Bennet | |
| 4,504,091 | A | 3/1985 | Ohshiro | |
| 4,730,394 | A * | 3/1988 | Sonner, Jr. | 30/161 |
| 4,856,385 | A | 8/1989 | Ogilvie | |
| 5,400,512 | A | 3/1995 | Brush | |
| 6,460,254 | B1 * | 10/2002 | Mori et al. | 30/286 |
| 6,796,033 | B2 | 9/2004 | Owoc | |
| 7,093,367 | B1 | 8/2006 | Huang | |
| 8,006,391 | B1 * | 8/2011 | Mashburn et al. | 30/339 |
| 2004/0231169 | A1 * | 11/2004 | Roberson | 30/321 |

* cited by examiner

*Primary Examiner* — Phong Nguyen
(74) *Attorney, Agent, or Firm* — Law Office of Mark Brown LLC; Christopher M. DeBacker; Mark Brown

(57) ABSTRACT

A knife that consist of a handle with a lockable and rotatable cutter head. The handle has a locking mechanism that secures the cutter head in numerous cutting positions and also in a safety position. The cutter head contains the blade. After the edges get dull the blade can be rotated within the cutter head to allow for the use of new cutting edges. The blade can easily be replaced by loosening the cutter head pivot bolt. The cutter head and pivot bolt remain attached to the knife during this process.

8 Claims, 7 Drawing Sheets

170
140
80
110
210
210
50
200
190
180
30

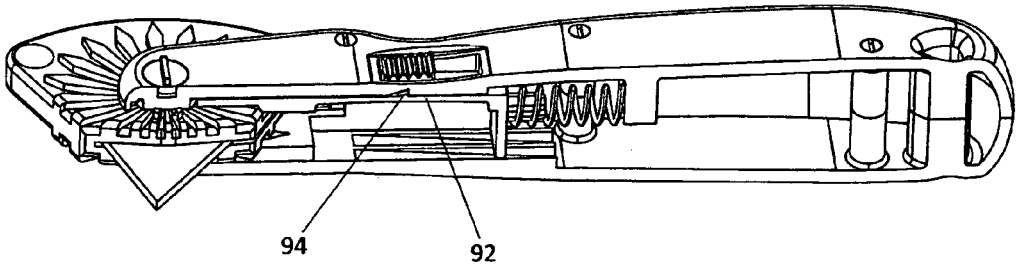
FIG. 8
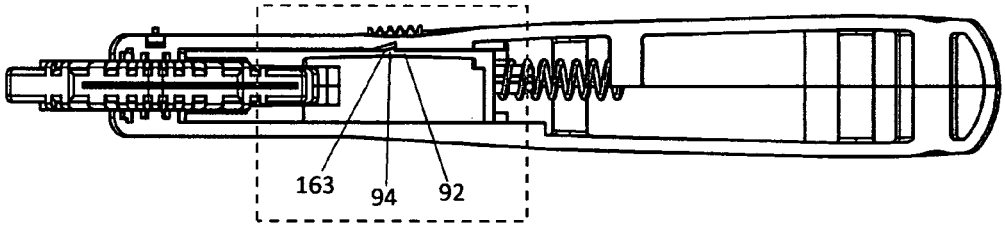
FIG. 9
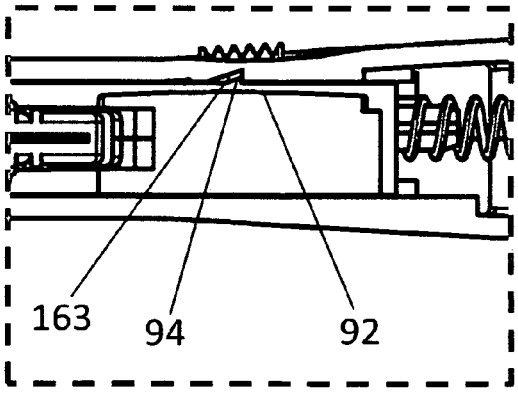

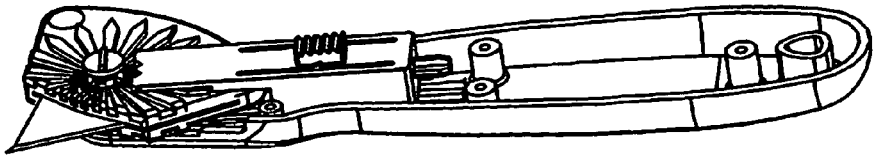
FIG. 10
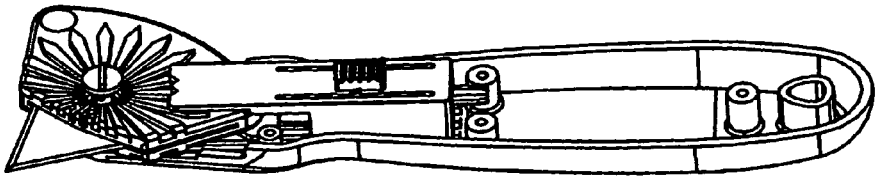
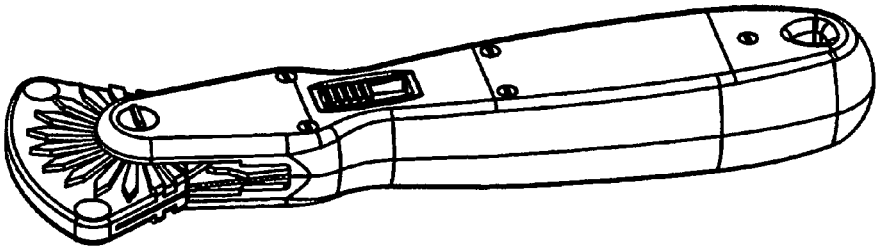
FIG. 11
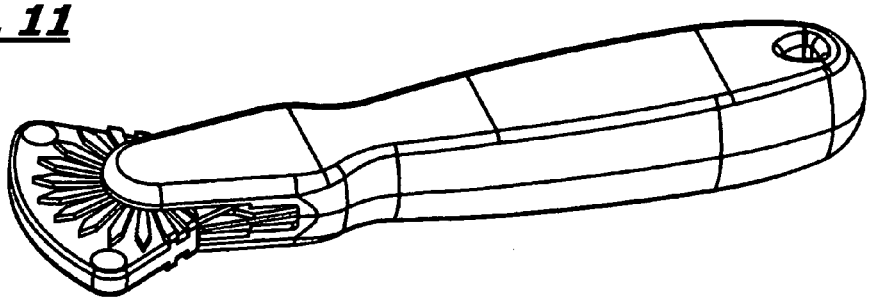

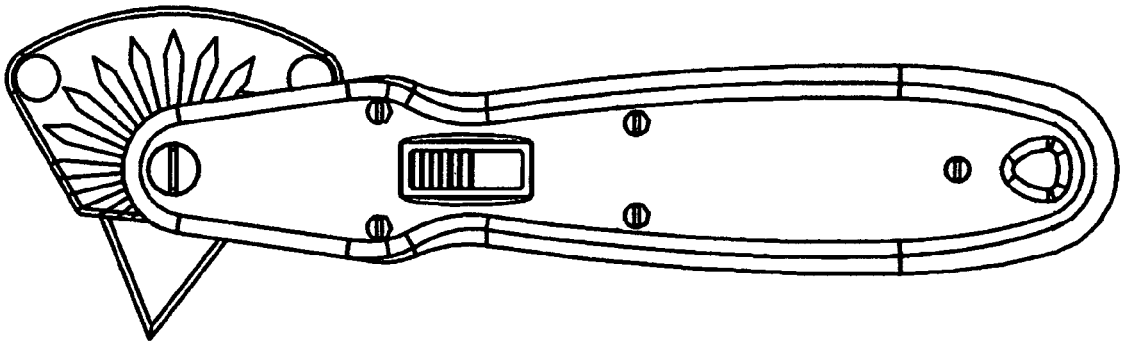
FIG. 12
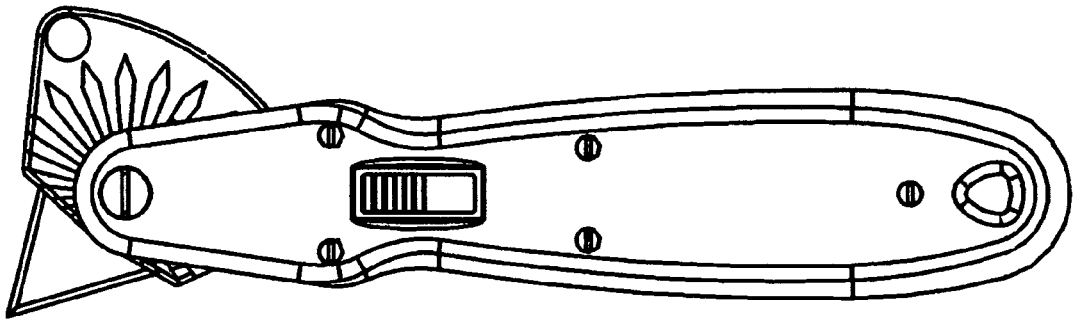

ROTATING HEAD MULTI-ANGLED CUTTING KNIFE

CROSS-REFERENCES TO RELATED APPLICATION

This application claims the benefit of provisional patent application 61/465,471 filed Mar. 21, 2011 by present inventors.

BACKGROUND

1. Field

This application relates to various cutters including the common utility knives and knives with blade to knife angle or blade angle to handle adjustments.

2. Prior Art

Conventional knives such as the common utility knives are well known in the art. These knives have many industrial as well as home uses. A typical knife allows the blade to be adjusted in a forward or retracted position.

The typical knife has the blade in a single fixed angle cutting position.

There are adjustable knife handles that allow for different blade to handle angles. None of these are designed to use the triangular blade along with other blade designs.

There is a need for an improved knife that provides additional features and options for the consumers.

The rotating head Multi Angle cutting knife has a dual locking head engagement feature. This provides a maximum lock when engaged.

SUMMARY

Accordingly, the object of the new invention is having a knife that is able to adjust to numerous cutting angles and positions for practical and ergonomic purposes. The knife will have use of two cutting blade areas at a time when in the cutting mode. It's 360 degree rotating head also allows the blade to be placed in a safe position when not in use.

Other aspects and advantages of the present invention will become more readily apparent in view of the following detail description and accompanying drawings.

BRIEF DESCRIPTION OF DRAWINGS

FIG. 8 Shows two cut away views of the cutters handle displaying the spring with slide lock in the locked position.

FIG. 9 Detailed view of flex member, slide engagement hook and lock engagement notches.

FIG. 10 Shows the slide lock movement. The upper view shows the slide lock in the forward/engaged and the other view shows it in the retracted/disengaged position.

FIG. 11 Depicts the isometric views of both sides of the cutter in the locked and safe position.

FIG. 12 Side view of knife in different head/blade angle position.

REFERENCE NUMERAL

Figure 1:
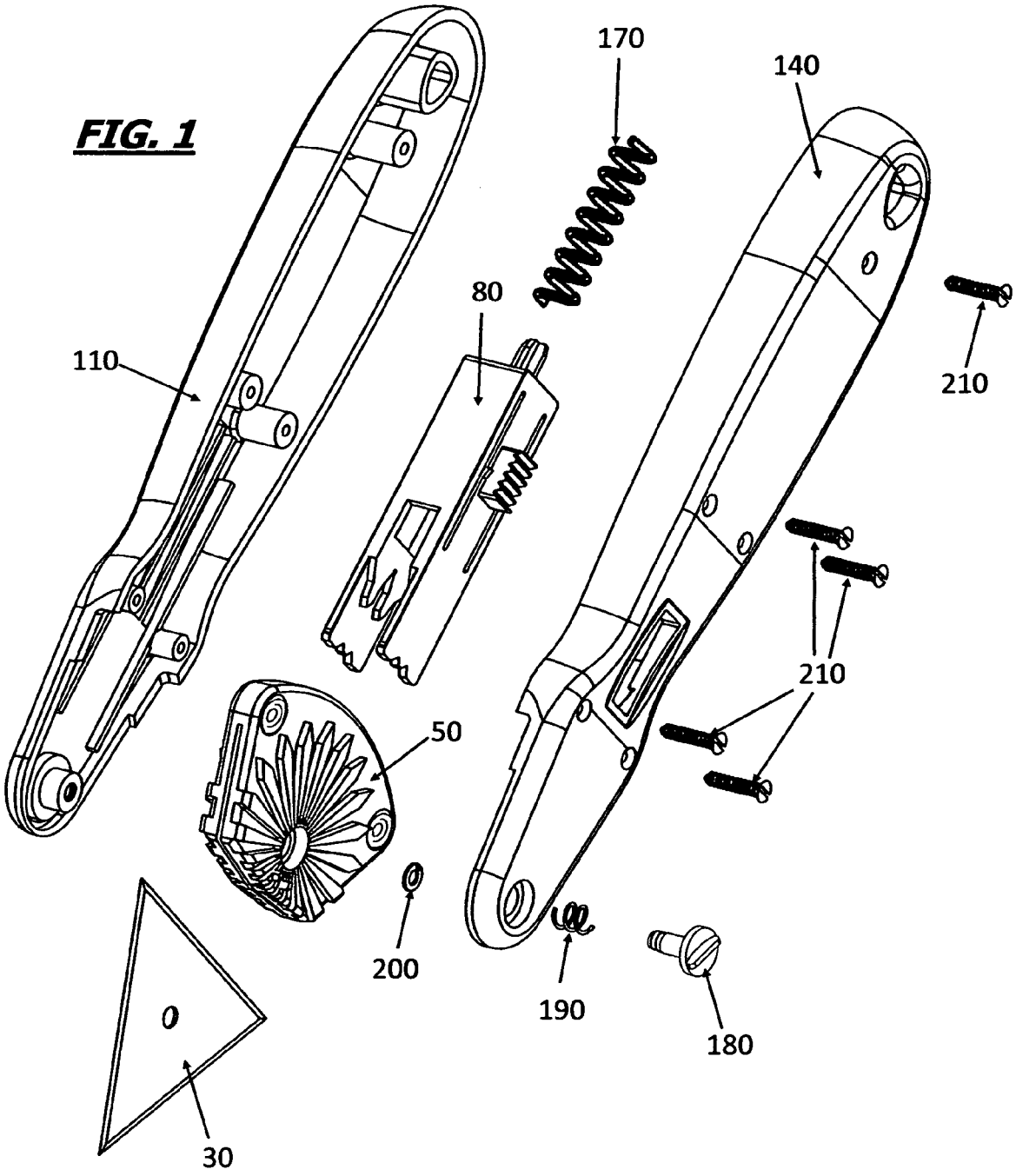
FIG. 1 Shows exploded view of all the parts that make up the cutter.

30 Blade
32 Blade cutting Edge
50 Cutter Head
52 Head Lock Rib
54 Head pivot hole
56 Finger Grip recess
58 Interior blade stop
60 Blade mounting slot
62 Safety lock Pegs
64 Locking alignment points
80 Lock
82 Spring lead in chamfer
84 Spring retaining boss
86 Finger push boss
88 Finger grip
90 Relief slots
92 Flex member
94 Slide engagement hook
96 Head safety lock feature
98 Alignment points
100 Head position locking fingers
102 Alignment point clearance
104 Double lock feature
110 Knife half without lock sliding window
140 Knife half with locks sliding window
142 Pivot hole
144 Bolt recess
146 Screw retaining hole
148 Slide lock window
150 Window recess
152 Handle hanging hole
154 Hole lead in
156 Finger grip area
158 Pivot boss
160 Lock slide area
162 Slide guide
163 Lock engagement notches
164 Spring retainer
166 Cutter Head pivot area
168 Lock slide ribs
170 Lock position spring
180 Cutter Head pivot bolt
182 Finger recess dimple
190 Compression spring
200 Bolt retaining clip
210 Mounting screws

DETAILED DESCRIPTIONS

The knife is designed to use a triangular shaped blade. It has a reversible grip feature which allows the user to cut with one side of the triangular blade and when dull just turn the knife handle over 180 degrees for a new cutting surface. When the two cutting surfaces are dull the blade can be removed and rotated allowing for two more new cutting surfaces. This can be repeated one more time giving two more new cutting surfaces. The blades can easily be removed and replaced without the use of tools.

The cutter head can be rotated 360 degrees and placed in numerous cutting positions and also be rotated to the save position when not in use. This allows the blade to be hidden safely within the knife handle.

The cutting head can be retrofitted to use the common utility blades or other blade designs.

As shown in FIG. 1, the blade 30 is received within a cutter head 50, which in turn is received by a lock 80. The lock 80 is mounted between a first half of a knife housing 110, which does not have a lock sliding window, and a second half of a knife housing 140, which does have a lock sliding window 148 within a window recess 150. A lock positioning spring 170 is located between the lock 80 and the two knife housing halves 110, 140. The second half of the knife housing 140 is affixed to the first half of the knife housing 110 via a plurality of screws 210. The blade 30 is secured within the cutter head 50 and between the two housings 110, 140 via a cutter head pivot bolt 180. A bolt retaining clip 200 is located between the cutter head 50 and the cutter head pivot bolt 180. A compression spring 190 is located between the bolt retaining clip 200 and the cutter head pivot bolt 180. The pivot bolt both secures the blade to the cutter head and the cutter head to the knife housing, but also allows the cutter head to rotate within the housing.

Figure 2:
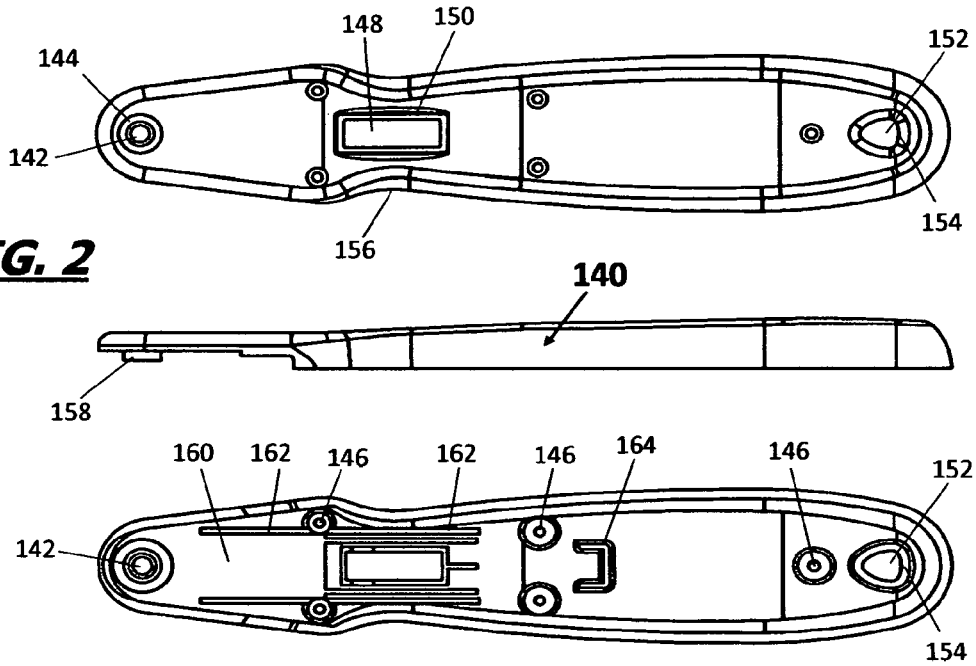
FIG. 2 Shows top, side and bottom view of case half with window for slide lock.
Figure 3:
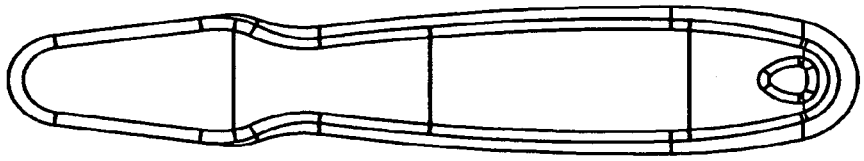
FIG. 3 Shows top, side and bottom view of case half without.

As shown in FIG. 2, the knife housing includes a finger grip area 156. The second knife housing half also includes a pivot hole 142 for receiving the pivot bolt 180, a bolt recess 144, a handle hanging hole 152 and a hole lead in 154. The first half knife housing 110 also includes a pivot hole 142 for receiving the pivot bolt 180, a lock slide area 160, a slide guide 162, a spring retainer 164 for receiving an end of the lock position spring, and a plurality of screw retaining holes 146. FIG. 3 additionally shows the pivot boss 158 and a cutter head pivot area 166. The pivot boss is associated with the pivot bolt 180, and the cutter head 50 is allowed to rotate about the pivot bolt 180 and pivot boss 158 within the cutter head pivot area 166.

Figure 4:
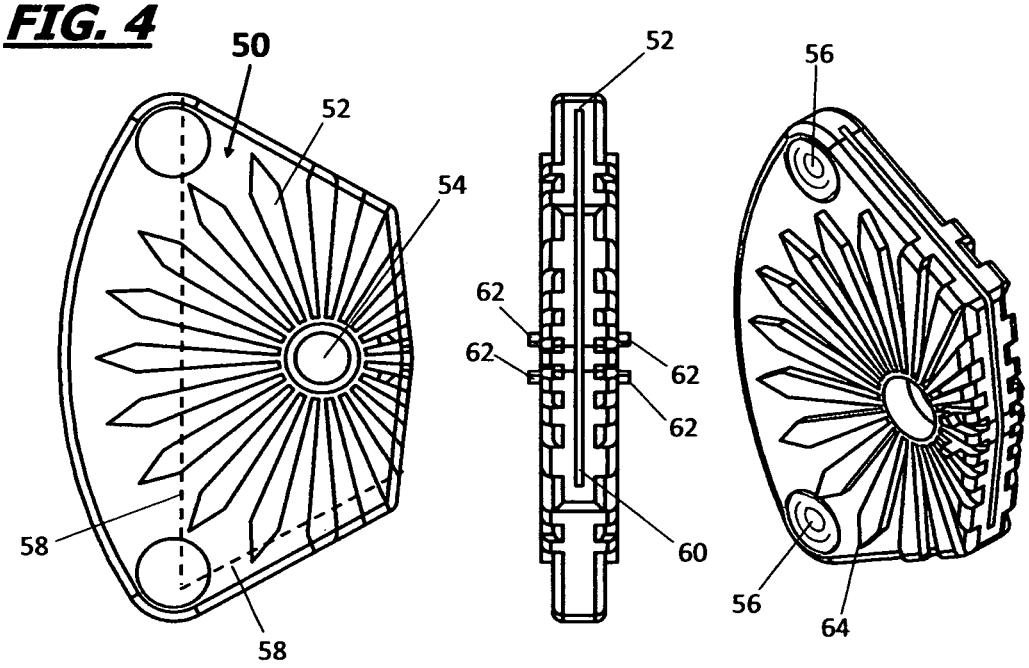
FIG. 4 Side view, end view and isometric view of the cutters head.

FIG. 4 shows the cutter head 50 in more detail. The cutter head includes a number of head lock ribs 52 which function to lock the cutter head at a chosen angle within the head pivot area 166. An interior blade stop 58 prevents the blade from being inserted into the cutter head further within the blade mounting slot 60. A head pivot hole 54 receives the pivot bolt 180. A number of safety lock pegs 62 are located on the cutter head 50. Finally, the cutter head 50 includes a pair of finger grip recesses 56 which make rotating the cutter head easier, and several lock alignment points 64 each associated with a head lock rib 52.

Figure 5:
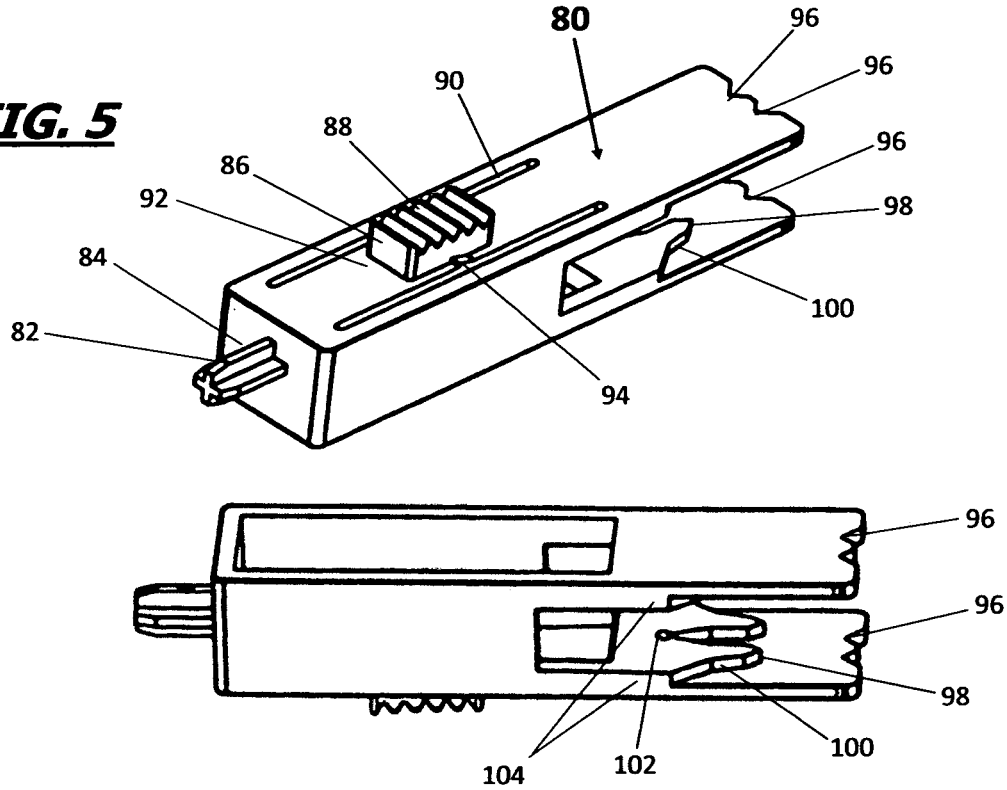
FIG. 5 Two isometric views of the slide lock.

FIG. 5 shows the lock 80 in more detail. The lock includes a slide engagement hook 94 between a pair of relief slots 90. A finger grip 88 is also positioned between the relief slots. The finger grip 88 includes a finger push boss 86. The lock 80 further includes a spring retaining boss 84 with a spring lead in chamfer 82 for receiving the lock position spring 170. The lock 80 further includes a number of head safety lock features 96 and a pair of head position locking fingers 100 with alignment points 98 for receiving the alignment points 64 of the head lock ribs 52 of the cutter head 50, thereby locking the cutter head at an angle.

Figure 6:
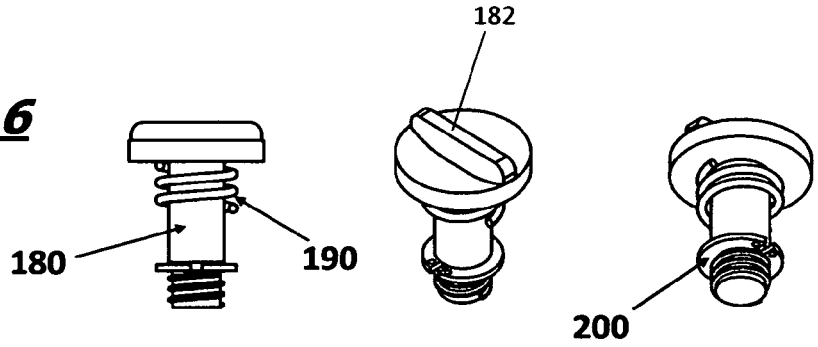
FIG. 6 Shows the cutter head pivot bolt, compression spring and retaining clip.
Figure 6:
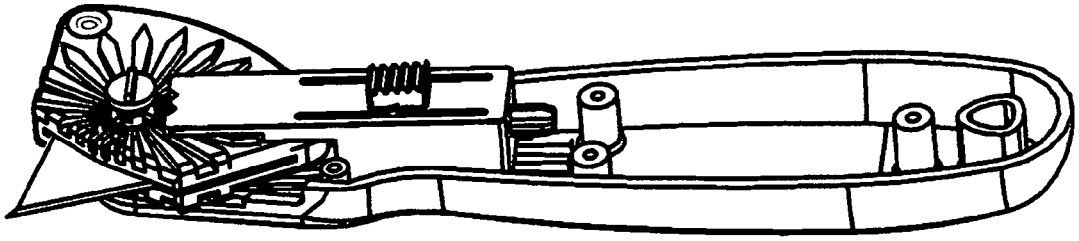

FIG. 6 shows the cutting head pivot bolt 180 in more detail, including the compressing spring 190, the bolt retaining clip 200, and a finger recess dimple 182 located on the head of the pivot bolt.

Figure 7:
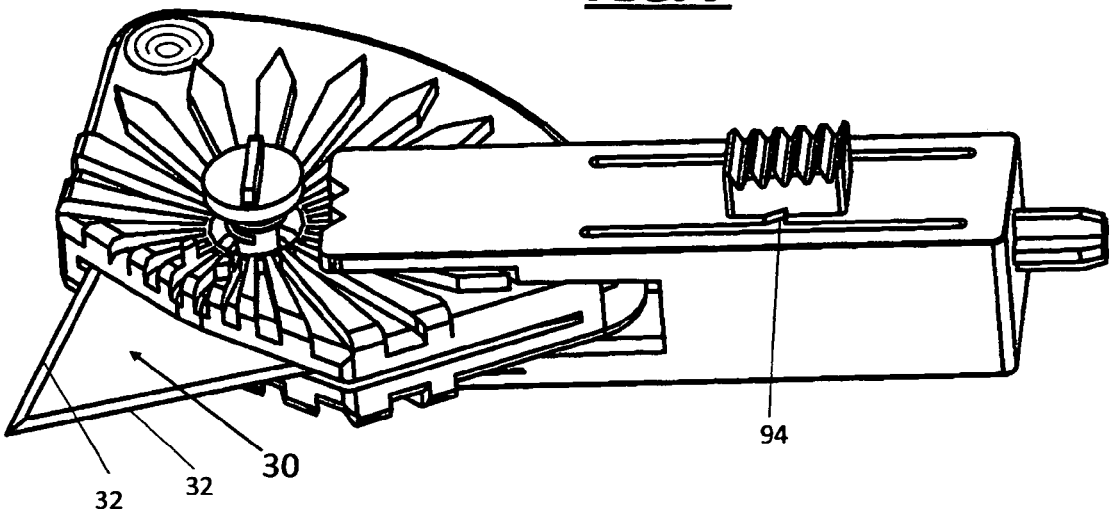
FIG. 7 The isometric view of slide lock in forward position engaged with cutter head.

FIG. 7 shows how the cutter head 50 is received by the lock 80 within the first half of the knife housing 110. It also shows two of the blade edges 32 of the blade 30. FIGS. 8 and 9 further show how the second half knife housing 140 is connected to the first half knife housing 110, thereby containing the cutter head 50 and the lock 80. The finger grip 88 is accessible through the slide lock window 148 and functions to lock or unlock the rotation of the cutter head 50.

The invention claimed is:

1. A utility knife comprising:

a rotatable head unit having first and second faces with a bolt receiver hole passing through the center of each face, each of said faces further including a plurality of raised locking ridges;

said rotatable head further including a knife blade receiver slot;

a slideable locking mechanism having a proximal end, a distal end, and a lock grip, wherein said slideable locking mechanism proximal end comprises a notch adapted to receive one of said plurality of raised locking ridges located on said rotatable head unit;

a disposable knife blade having three sharpened edges and a bolt receiver hole located in the center of said blade, said knife blade adapted for the insertion of one of said three sharpened edges into said knife blade receiver slot of said rotatable head;

a housing having a proximal end and a distal end, wherein a bolt receiver hole is located in proximity to said proximal end, and wherein said distal end provides an ergonomic grip;

said housing further including a switch receiver slot adapted to receive said lock grip, wherein said lock grip is adapted to slide between a locked and an unlocked position within said switch receiver slot; and a locking bolt threaded through the bolt receiver holes of said housing, said rotatable head, and said knife blade, thereby locking said knife blade such that two of said three sharpened edges are exposed from said rotatable head.

2. The utility knife of claim 1, further comprising:

a pair of finger grip recesses located on each of said rotatable head faces; and wherein said finger grip recesses are adapted for an ergonomic interface.

3. The utility knife of claim 1, wherein said lock grip includes a rough external face extending through said switch receiver slot.

4. The utility knife of claim 1, further comprising:

a spring inserted inside said housing in proximity to said distal end; and said spring engaged with the distal end of said slidable locking mechanism.

5. The utility knife of claim 4, further comprising:

an engagement notch located on the internal face of said housing;

an engagement hook located on a face of said slidable locking mechanism; and wherein said engagement hook is adapted to engage with said engagement notch thereby preventing said slideable locking mechanism from sliding toward said distal end of said housing beyond a predetermined distance.

6. The utility knife of claim 5, further comprising:

said slideable locking mechanism adapted for locking said rotatable head at a predetermined angle determined by said plurality of raised ridges; and whereby each of said raised ridges conforms to a different predetermined angle.

7. The utility knife of claim 6, further comprising:

one of said plurality of raised edges corresponding to an angle wherein said exposed knife blade edges are directed toward the distal end of said housing, and thereby concealed by said housing.

8. The utility knife of claim 1, wherein said disposable knife blade is adapted to be rotated, thereby exposing the third of said three sharpened edges upon at least one of said other two sharpened edges becoming dulled.

* * * * *